US009388583B2

(12) United States Patent
Lindberg

(10) Patent No.: US 9,388,583 B2
(45) Date of Patent: Jul. 12, 2016

(54) BUILDING BOARD AND METHOD OF MOUNTING

(71) Applicant: Oneday Wall AB, Orebro (SE)

(72) Inventor: Peter Lindberg, Orebro (SE)

(73) Assignee: ONEDAY WALL AB, Orebro (SE)

( * ) Notice: Subject to any disclaimer, the term of this patent is extended or adjusted under 35 U.S.C. 154(b) by 0 days.

(21) Appl. No.: 14/420,637

(22) PCT Filed: Sep. 16, 2013

(86) PCT No.: PCT/SE2013/051074
§ 371 (c)(1),
(2) Date: Feb. 9, 2015

(87) PCT Pub. No.: WO2014/046597
PCT Pub. Date: Mar. 27, 2014

(65) Prior Publication Data

US 2015/0204079 A1 Jul. 23, 2015

(30) Foreign Application Priority Data

Sep. 18, 2012 (SE) ..... 1251040

(51) Int. Cl.
*E04F 13/08* (2006.01)
*E04C 2/40* (2006.01)
(Continued)

(52) U.S. Cl.
CPC ..... *E04F 13/0894* (2013.01); *E04C 2/40* (2013.01); *E04F 13/26* (2013.01); *E04F 15/02038* (2013.01); *E04B 2/7457* (2013.01); *E04F 13/0826* (2013.01); *E04F 2201/023* (2013.01)

(58) Field of Classification Search
CPC . E04F 13/0894; E04F 13/26; E04F 15/02038; E04F 2201/023; E04F 13/0826; E04C 2/40
USPC ..... 52/475.1, 478, 483.1, 481.1, 589.1
See application file for complete search history.

(56) References Cited

U.S. PATENT DOCUMENTS 3,131,442 A * 5/1964 Persson-Melin ..... 52/222
3,362,120 A * 1/1968 Warren ..... 52/309.2
(Continued)

FOREIGN PATENT DOCUMENTS

GB 2216918 A 10/1989
SE 445476 B 1/1982
(Continued)

OTHER PUBLICATIONS

International Search Report for PCT/SE2013/051074 dated Dec. 16, 2013.
(Continued)

*Primary Examiner* — Brian Mattei
*Assistant Examiner* — Paola Agudelo
(74) *Attorney, Agent, or Firm* — Moore & Van Allen PLLC; W. Kevin Ransom

(57) ABSTRACT

A building board for mounting on a support structure including a set of studs. The building board comprising a framing element essentially shaped as a rectangular cuboid including two opposite main sides having relatively large delimitation surfaces and four edge sides having relatively small delimitation surfaces. A first type of snap-in means are arranged along a first edge side and a second type of snap-in means are arranged along a second edge sides opposite to said first edge side. The snap-in means of the first type is, after mounting of the building board against the support structure, configured to receive a snap-in means of the second type of another building board so that this building board is connected to the mounted building board. Either the snap-in means of said first or second type includes a groove for receiving at least one clamping element for fixing and holding the first and the second building boards against a stud of the support structure.

17 Claims, 5 Drawing Sheets

(51) Int. Cl.

| | |
|---|---|
| ***E04F 13/26*** | (2006.01) |
| ***E04F 15/02*** | (2006.01) |
| *E04B 2/74* | (2006.01) |

(56) References Cited

U.S. PATENT DOCUMENTS

| | | | | |
|---|---|---|---|---|
| 3,427,771 | A * | 2/1969 | Cacossa | 52/262 |
| 3,585,772 | A * | 6/1971 | Seegert | 52/483.1 |
| 3,667,180 | A * | 6/1972 | Tischuk | 52/309.2 |
| 4,065,902 | A * | 1/1978 | Lindal | 52/782.1 |
| 4,463,533 | A * | 8/1984 | Mullet | E04D 3/352 52/394 |
| 4,936,078 | A * | 6/1990 | Porter | E04C 2/296 52/478 |
| 5,758,464 | A * | 6/1998 | Hatton | 52/404.1 |
| 8,621,810 | B2 * | 1/2014 | Manser et al. | 52/506.05 |
| 8,789,336 | B2 * | 7/2014 | Lindberg | E04F 19/022 52/288.1 |
| 2006/0010820 | A1 | 1/2006 | Schwitte et al. | |
| 2008/0216444 | A1 * | 9/2008 | Loyd | E04F 13/0803 52/742.16 |
| 2010/0122505 | A1 * | 5/2010 | Jakiel | A47F 5/0846 52/483.1 |
| 2011/0197535 | A1 | 8/2011 | Baker et al. | |
| 2014/0260043 | A1 * | 9/2014 | Cottier | E04F 13/0826 52/489.2 |

FOREIGN PATENT DOCUMENTS

| | | | |
|---|---|---|---|
| SE | 455476 | B | 1/1982 |
| WO | WO 9606241 | A1 | 2/1996 |
| WO | WO 2010/044728 | A1 | 4/2010 |

OTHER PUBLICATIONS

International Preliminary Search Report (IPSR) for PCT/SE2013/051074 dated Mar. 24, 2015.
ISR Written Opinion for PCT/SE32013/051074 dated Dec. 16, 2013.
Office Action for Chinese Patent Application No. 201380047663.2 issued on Dec. 1, 2015.

* cited by examiner

BUILDING BOARD AND METHOD OF MOUNTING

BACKGROUND TO THE INVENTION AND PRIOR ART

The present invention relates generally to solutions for mounting cladding in and onto edifices, such as on inner walls, floors, ceilings and facades. Particularly, the invention pertains to a building board building board for mounting on a support structure including a set of studs.

Today, there are many solutions for mounting cladding, for example in the form of wooden panels and similar on the walls of a house. Moreover, there are established methods for mounting other kinds of wall coatings inside a room, such as boards of plaster, wood fiber or laminated wood. A common denominator for the latter methods is that they require particular measures to accomplish good looking joints between the different wall elements of the coating. To combine an aesthetically appealing look with an uncomplicated and cost-efficient manufacturing has proven to be especially challenging.

For example WO 2010/044728 discloses a method for manufacturing a building board, wherein a first armoring layer is arranged on a flat support. Thereafter, edge strips are arranged preferably along two opposite sides of the armoring layer and a volume between the edge strips is filled with a hardenable substance, such as plaster. A second armoring layer is then arranged on top of the hardenable substance, where after said substance is set to harden. As a result, a building board having integrated edge strips is obtained, which suitably are adapted to allow an efficient interconnection of two or more building boards onto a support structure, such as along a wall of a house.

The above-mentioned solution for manufacturing building boards renders it possible to accomplish boards for covering floors, ceilings or walls, which boards both provide aesthetically appealing joints and are robust from a design point-of-view. Attaching the building boards to a support structure, such as a structure including studs, is, however, not entirely uncomplicated since it requires a set of screws to mechanically connect each building board to the support structure.

SUMMARY OF THE INVENTION

The object of the present invention is therefore to provide a solution through which building boards can be mounted onto a support structure in a cost-efficient, simple and safe manner.

According to a first aspect of the invention, the object is achieved by the initially described building board, wherein either the snap-in means of said first or second type comprises a groove configured to receive at least one clamping element for fixing and holding the first and the second building boards against a stud of the support structure.

This building board is advantageous, since its configuration considerably facilitates mounting of the building board onto a building structure, which includes studs.

According to one embodiment of this aspect of the invention, the first type of snap-in means is arranged in a first edge structure of the building board. The first edge structure may further include a first edge lath, which is integrated into the building board. Correspondingly, the second type of snap-in means is arranged in a second edge structure of the building board, which second edge structure may include a second edge lath integrated into the building board.

According to another embodiment of this aspect of the invention, the first and second edge laths essentially consist of one of: aluminum, plastic, rubber, wood or MDF [Medium Density Fibre-board]. These materials are all advantageous depending on in which type of building and environment the building board is to be used. Further, the framing element may comprise a ceramic material, plaster, glass, concrete, mineral wool or paperboard. These materials may likewise be advantageous depending on in which type of building and environment that the building board is to be used.

According to a further embodiment of this aspect of the invention, the edge laths have been integrated into the building board during a manufacturing process in which the framing element was created, for example via casting. Thereby, the edge laths may be made of another material than the framing element, and the material characteristics of the edge laths and the framing element respectively can be adapted to the requirements placed on each respective part, for instance regarding durability, processing ability and cost.

According to a further embodiment of this aspect of the invention, at least one of the snap-in means constitutes a part of the framing element. Here, a cross-section profile of the snap-in means in question is created by removing material from the framing element while it is solid. This is desirable because it enables a very simple and efficient manufacturing process for the building board.

According to a yet another embodiment of this aspect of the invention, the first type of snap-in means is of female type and the second type of snap-in means is of male type. Thereby, the mounting method can be made particularly uncomplicated.

According to a yet another embodiment of this aspect of the invention, at least the main sides of the building board are covered with an armoring layer, which covers the respective main side. Such an armoring layer gives the building board good durability and contributes to providing the building board with an aesthetically appealing surface.

According to a second aspect of the invention, the object is achieved by the initially described method, wherein a first leg of a clamping element is inserted into a groove of either the snap-in means of said first or second type. A second building board is interconnected with the first building board by inserting a snap-in means of the second type of the second building board into the first building board's snap-in means of the first type. Then, the second building board is mounted against the support structure, so that a first edge side of the second building board adjoins a stud of the support structure. The advantages of this method are apparent from the above discussion with reference to the proposed building board.

BRIEF DESCRIPTION OF THE DRAWINGS

The present invention will now be explained more closely by means of embodiments, which are described as examples, and with reference to the attached drawings.

DESCRIPTION OF EMBODIMENTS OF THE INVENTION

Figure 1:
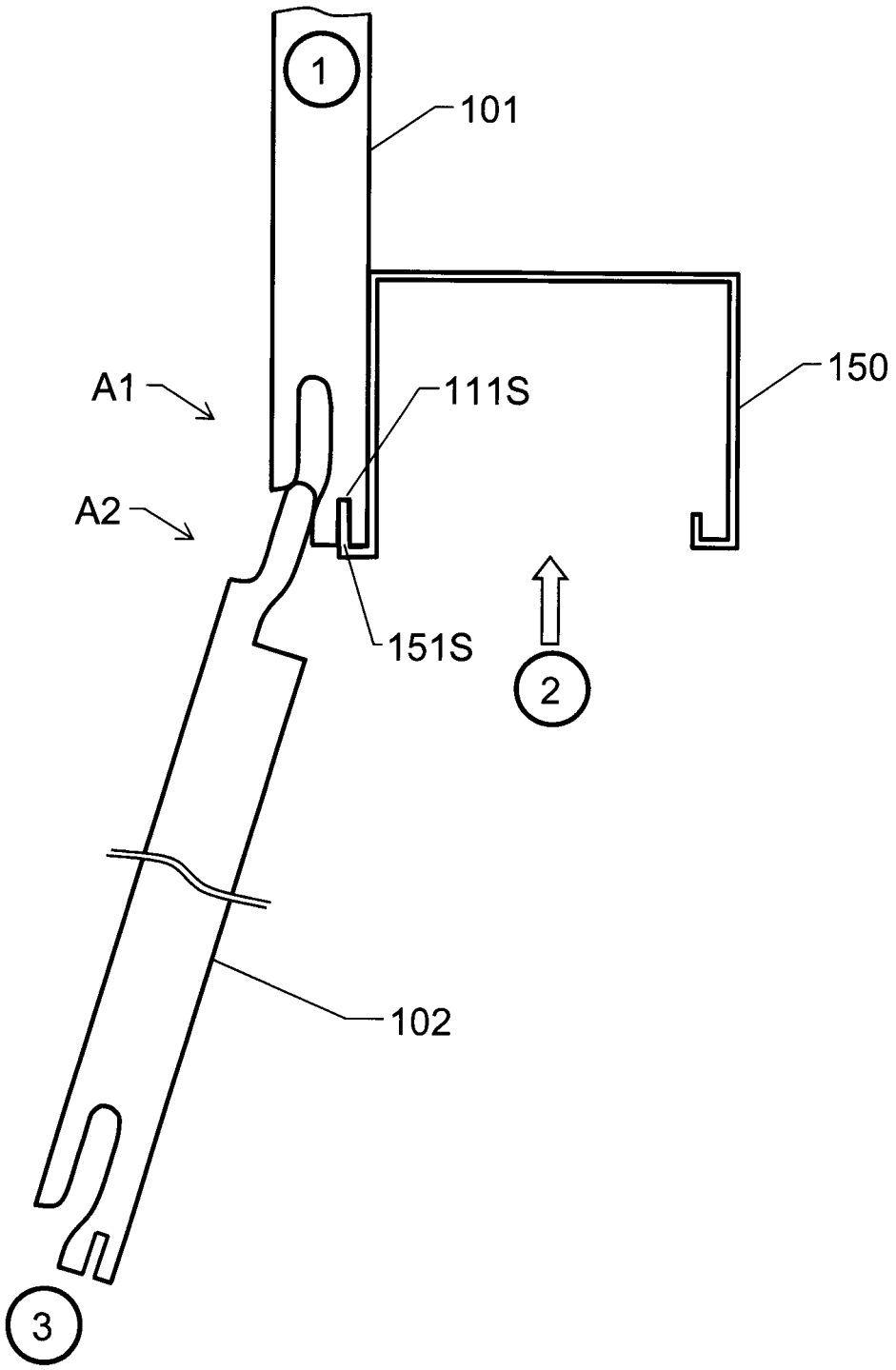
FIG. 1 schematically illustrates how building boards and a stud are mounted according to a first embodiment of the invention, FIG. 2 schematically illustrates how building boards and a stud are mounted according to a second embodiment of the invention, FIGS. 3*a*-*b* schematically illustrate how building boards and a stud are mounted according to a third embodiment of the invention, FIGS. 4*a*-*b* schematically illustrate how building boards and a stud are mounted according to a fourth embodiment of the invention.

Initially, we refer to FIG. 1, which schematically illustrates how two building boards are interconnected and fixed against a stud 150 according to a first embodiment of the invention. After having been mounted it is presumed that the stud 150 will be part of a support structure together with a number of similar studs.

According to the invention, each building board comprises a respective framing element 101, 102, which has an essential shape of a rectangular cuboid including two opposing main sides having relatively large delimitation surfaces and four edge sides having relatively small delimitation surfaces.

A first type of snap-in means A1, for example of female type, is arranged along a first edge side of each building board. A second type of snap-in means A2, for example of male type, is arranged along a second edge side of each building board. As is apparent from FIG. 1, the second edge side is opposite to the first edge side. The snap-in means of the first type A1 is configured to, after mounting of the building board against the support structure, receive a snap-in means of the second type A2 of another building board, such that this building board is interconnected with the already mounted building board.

The snap-in means of the first type A1 also comprises a groove 111S, which is configured to receive at least one clamping element 151A for fixing and holding the building board against the stud 150. Here, the clamping element 151S is included as an integral part of the stud 150. This, in turn, means that it is suitable to mount the stud 150 after that a first building board has been placed in a desired position. If for example the building board is a wall board the stud 150 may be controlled to a desired position via at least one of a floor rail and a ceiling track that is parallel with the wall that is to be built. The positioning of the first building board is illustrated by an encircled number 1 in FIG. 1. Correspondingly, the snapping in of the first building board against the stud 150 by inserting the clamping element 151S is illustrated by an encircled number 2, and the interconnection of the second building board with the first building board via the span-in means A1 and A2 is illustrated by an encircled number 3.

According to one embodiment of the invention, the first type of snap-in means A1 is arranged in a first edge side structure of the building board, such that the snap-in means A1 and/or A2 constitute a part of the actual framing element 101 and/or 102 respectively. This can be accomplished by first casting a building board in a conventional form, i.e. as a rectangular cuboid. After having hardened the building board, desired edge profiles of the snap-in means A1 and/or A2 are created by removing material from the framing element 101 and 102 respectively, for instance by milling.

Figure 2:
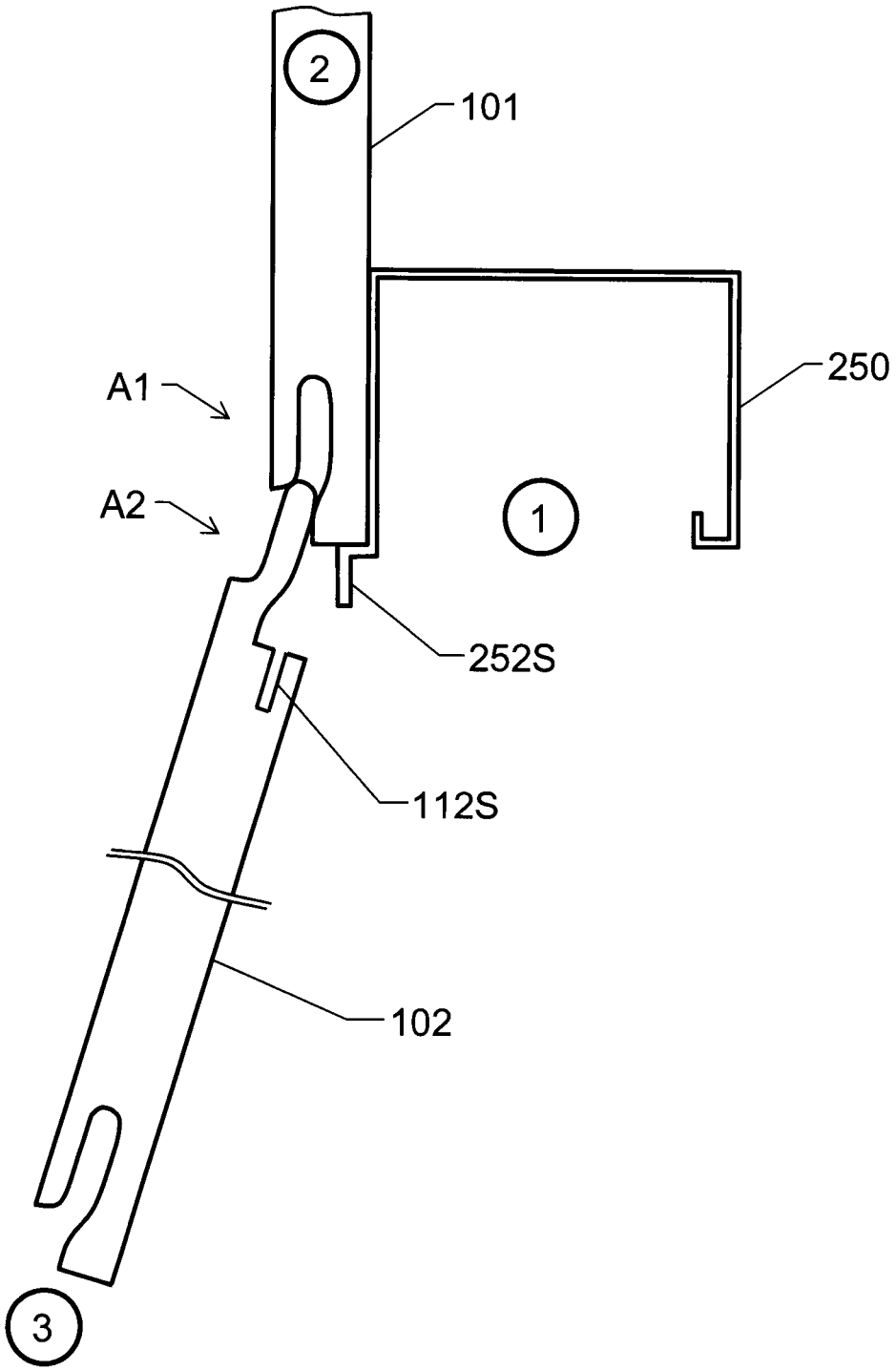

FIG. 2 shows, schematically, in cross section, how two building boards are interconnected and fixed against a stud 250 according to a second embodiment of the invention. All reference numerals which coincide with those in FIG. 1 designate the same elements as have been described above with reference to FIG. 1. As is apparent from FIG. 2, the snap-in means A2 of the second type comprises a groove 112S. This groove, in turn, is configured to receive at least one clamping element 252S of the stud 250. This configuration means that when mounting, the stud 250 is suitably first positioned in a support structure, which is indicated by an encircled number 1. Thereafter, a first building board is mounted against the stud 250, as shown in FIG. 2, which is indicated by an encircled number 2. The stud 250 is provided with an integrated first leg 252S. A second building board is interconnected with the first building board by inserting a snap-in means of the second type A2 of the second building board into the first building board's snap-in means of the first type A1. In connection with this, the first leg 252S is also inserted into a groove 112S in the snap-in means of the second type A2 of the second building board. This results in that the second building board is mounted against the stud 250, such that a first edge side of the second building board adjoins the stud 250, which is designated by an encircled number 3.

Since the edge structure in which the groove 112S is included is relatively durable, for example because the edge structure comprises a particular edge lath or the edge structure includes a reinforcing material, the groove may configured to, based on friction, fix the first and the second building boards against the stud 250 of the support structure in which this is included.

Figures 3A, 3B:
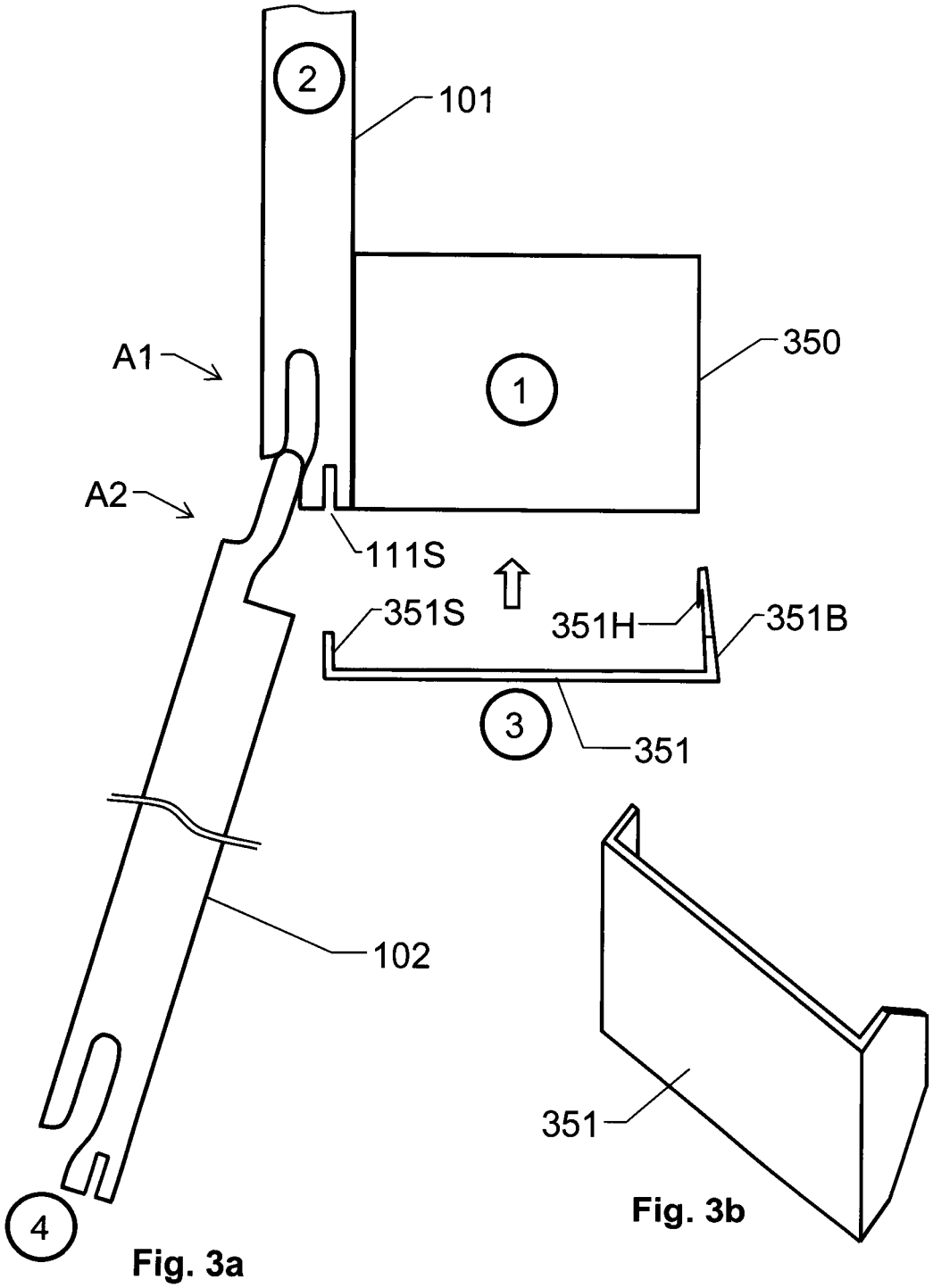

FIG. 3*a* shows, schematically, in a cross section profile, how two building boards are interconnected, fixed and held against a stud 350 according to a third embodiment of the invention.

The stud 350, which may be a conventional wooden stud, is preferably mounted in a first step, which is illustrated by means of an encircled number 1. Thereafter, a first building board is positioned such that a distal side of its snap-in means of the first type A1 adjoins a side of the stud 350 which is essentially perpendicular to the main sides of the first building board. This is illustrated by an encircled number 2. Then, at least one clamping element 351 is inserted into the groove 111S, which is illustrated by an encircled number 3. The clamping element 351 has such dimensions in relation to the stud 350 and is applied in such a manner around the stud 350 that the first building board, after having inserted the clamping element 351, is fixed and held against the stud 350. The clamping element 351 preferably comprises a first leg 351S configured to be inserted into the groove 111S and another leg 351B configured to grip around a corner of the stud 350 as illustrated in FIG. 3*a*. The second leg 351B is further preferably provided with a locking means in the form of a barb 351H to retain the clamping element 351 in position around the stud 350.

FIG. 3*b* shows a perspective view of the proposed clamping element 350.

When the first building board has been fixed against the stud 350 according to the above procedure, a second building board may be interconnected with the first building board by connecting the second building board's snap-in means of the second type A2 with the first building board's snap-in means of the first type A1. This is illustrated by an encircled number 4.

Figures 4A, 4B:
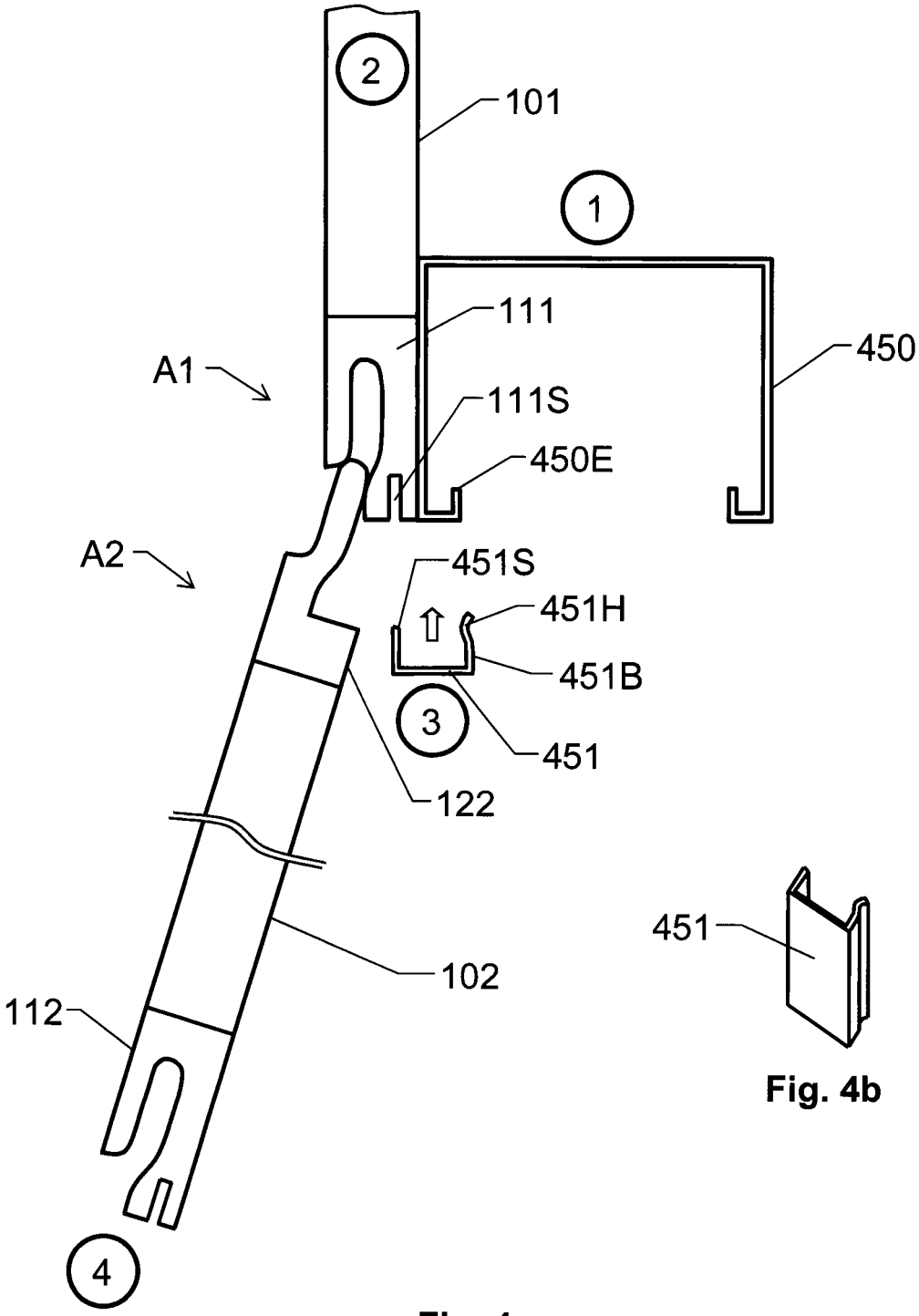

FIG. 4*a* shows, schematically, in a cross section profile, how two building boards are interconnected, fixed and held against a stud 450 according to a fourth embodiment of the invention.

The stud 450 is preferably a metal profile, which for example has a general U-shape as illustrated in FIG. 4. Analogous to the above described embodiment the stud 450 is preferably mounted in a first step, which is illustrated by an encircled number 1. Thereafter, a first building board is positioned such that a distal side of its snap-in means of the first type A1 adjoins a side of the stud 450 which is essentially perpendicular to the main sides of the first building board. This is illustrated by an encircled number 2. Then, at least one clamping element 451 is inserted into the groove 111S, which is illustrated by an encircled number 3. The clamping element 451 has such dimensions in relation to the stud 450 and its profile that, when the clamping element 451 is inserted into the groove 111S and is applied around a protrusion 450E of the stud 450, the first building board is fixed and held against the stud 450.

The clamping element 451 preferably comprises a first leg 451S configured to be inserted into the groove 111S and a second leg 451B configured to grip around said protrusion of the stud 450 (as illustrated in FIG. 4*a*). Furthermore, the second leg is preferably provided with a locking means in the form of a curved element 451H configured to retain the clamping element 451 in position at the stud 450. FIG. 4*b* shows a perspective view of the proposed clamping element 451, from which for example appropriate designs of the legs 451S and 451B are apparent.

When the first building board has been fixed against the stud 450 according to the above procedure, a second building board may be interconnected with the first building board by connecting the second building board's snap-in means of the second type A2 with the first building board's snap-in means of the first type A1. This is shown with an encircled number 4.

According to one embodiment of the invention at least one of the first type of snap-in means A1 and the second type of snap-in means A2 is provided in an edge lath 111 and 112 respectively, which, in turn, is integrated into the building board. The edge laths 111 and 112 may either be glued to the framing element 101 and/or 102 or the edge laths 111 and 112 are integrated therein in connection with a manufacturing process in which the framing element 101/102 is formed, such as through casting.

The framing element 101/102 may preferably consist of, or mainly include, a brittle material, such as plaster or a ceramic material; a hard material, such as glass or concrete; or a soft material, such as mineral wool of paperboard.

Regardless of whether separate edge laths 111/112 have been merged with the framing element 101/102 or if the snap-in means A1/A2 have been produced by removing material from the framing element 101/102, it is advantageous if at least one of the main sides of the building board is covered by an armoring layer, which covers the entire main side (i.e. also a possible edge lath 111/112).

If the support structure is a wall structure, this preferably also includes at least one of a floor rail and a ceiling track to which said studs 150, 250, 350 and 450 respectively are connected and which are adapted to abut building boards in the form of wall boards.

Figure 5:
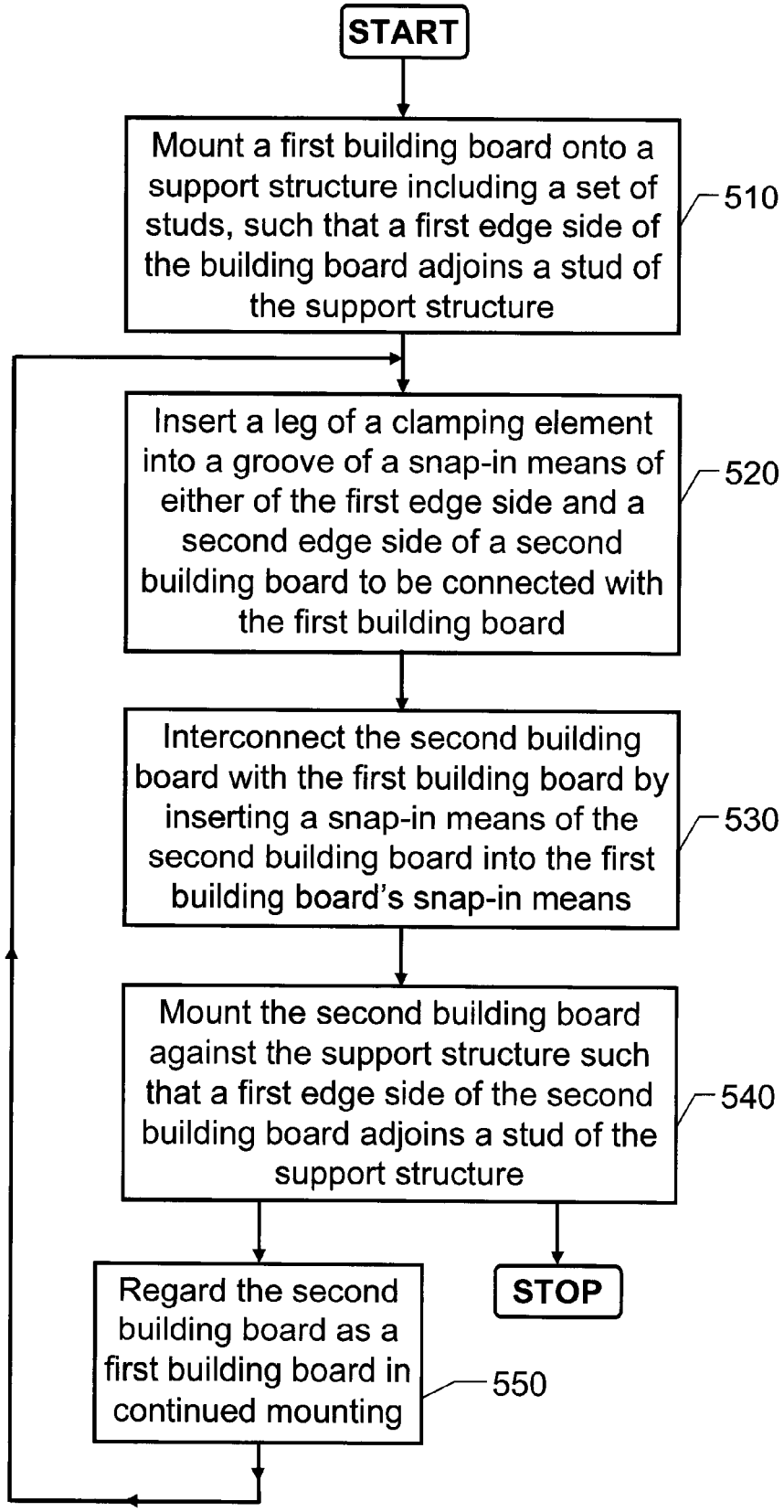
FIG. 5 shows a flow chart over the general method according to the invention.

To sum up, the general method according to the invention for mounting building boards onto a support structure including a set of studs will now be described with reference to the flow chart in FIG. 5.

In a first step 510, a first building board is mounted, such that a first edge side thereof adjoins a stud of a support structure. This may either involve placing the building board in desired position and then mounting a stud (as in FIG. 1), or first mounting and thereafter positioning the building board at the stud (as in FIGS. 2, 3 and 4).

In any case, in a subsequent step 520, a leg of a clamping element is inserted into a groove of a snap-in means of either of the first edge side of the first building board or a second edge side of a second building board. If the clamping element is inserted into the first edge side of the first building board, according to some embodiments of the invention, a second leg of the clamping element is also fitted around an edge of the stud, such that the first building board is fixed and held against the stud. As mentioned above, in such a case, it is advantageous if the second leg of the clamping element comprises a locking means configured to, via mechanical tightening, grip into said stud and thereby fix the first building board to the support structure.

In a step 530, which is either executed in parallel with or after step 520, the second building board is interconnected with the first building board by inserting a snap-in means of a second type of the second building board into the first building board's snap-in means of the first type.

In a step 540 subsequent thereto, the second building board is mounted against the support structure, such that a first edge side of the second building board adjoins a stud in the same manner as the first building board in step 510 above. If the building cladding is competed thereby, the mounting is finished. Otherwise, a step 550 follows in which the second building board is regarded as the first building board, and the procedure loops back to step 520

The invention is not restricted to the embodiments, which have been described above with reference to the drawings, however it may be varied freely within the scope of the subsequent claims.

The invention claimed is:

1. A building board for mounting on a support structure including a set of studs, the building board comprising:
   - a framing element which has an essential shape of a rectangular cuboid including two opposite main sides having relatively large delimitation surfaces and four edge sides having relatively small delimitation surfaces;
   - a first type of snap-in means integrated into a first one of said edge sides between the two opposite main sides;
   - a second type of snap-in means integrated into a second one of said edge sides between the two opposite main sides, which second edge side is opposite to said first edge side,
   - wherein the snap-in means of the second type being configured to be slidably inserted into and received by a snap-in means of the first type of another building board; and
   - a groove defined in either the first one of said edge sides or the second of said edge sides, wherein said groove is adjacent to and spaced apart from the first or second type of snap-in means arranged in the edge side, wherein said groove defines an opening in an edge side of said framing element and said groove extending laterally, inward from the edge side of said framing element and configured to receive at least one clamping element inserted in the groove for fixing and holding the building board against a stud of a support structure.

2. The building board according to claim 1, wherein the first type of snap-in means is arranged in a first edge structure of the building board.

3. The building board according to claim 2, wherein the first edge structure includes a first edge lath which is integrated into the building board.

4. The building board according to claim 2, wherein the second type of snap-in means is arranged in a second edge structure of the building board.

5. The building board according to claim 4, wherein the second edge structure includes a second edge lath which is integrated into the building board.

6. The building board according to claim 5, wherein the first and second edge laths essentially consist of one of: aluminum, plastic, rubber, wood or MDF (Medium Density Fiberboard).

7. The building board according to claim 6, wherein the first and second edge laths are integrated with the framing element.

8. The building board according to claim 5, wherein one of said main sides is covered with an armoring layer, which covers the respective side of said main sides.

9. The building board according to claim 1, wherein either of the snap-in means of said first or second type constitutes a part of the framing element.

10. The building board according to claim 1, wherein the first type of snap-in means is of female type and the second type of snap-in means is of male type.

11. The building board according to claim 1, wherein the framing element comprises at least one of: a ceramic material, plaster, glass, concrete, mineral wool or paperboard.

12. The building board according to claim 1, wherein said groove extends laterally, inward from the edge side of said framing element in a direction substantially parallel to at least one of the two opposite main sides of said framing element.

13. A method of mounting building boards on a support structure including a set of studs comprising:

providing a first building board comprising a framing element which has an essential shape of a rectangular cuboid including two opposite main sides having relative large delimitation surfaces and four edge sides having relatively small delimitation surfaces, a first type of snap-in means being arranged along a first one of said edge sides and a second type of snap-in means being arranged along a second one of said edge sides, which second edge side is opposite to said first edge side and the snap-in means of the first type after mounting of the building board against the support structure being configured to receive a snap-in means of the second type of a second building board so that a first edge side of said edge sides adjoins a stud of the support structure;

inserting a first leg of a clamping element into a groove of the snap-in means of the first type;

fitting a second leg of the clamping element around an edge of the stud so that the building board is fixed against the stud;

interconnecting a second building board with the first building board by inserting a snap-in means of the second type of the second building board into the first-building board's snap-in means of the first type; and thereafter mounting the second building board against the support structure so that a first edge side of said edge sides of the second building board adjoins a stud of the support structure.

14. The method according to claim 13, wherein the second leg of the clamping element comprises a locking means configured to, via mechanical tightening, gripping into said stud and thereby fixing the first building board to the support structure.

15. The method according to claim 13, wherein the support structure includes at least one of a floor rail and a ceiling track to which said set of studs is connected and adapted to adjoin said first and second building boards.

16. The method according to claim 13, wherein the groove is spaced apart from the first type of snap-in means and defines an opening in an edge side of said framing element and extending laterally, inward from the edge side of said framing element and configured to receive at least one clamping element inserted in the groove for fixing and holding the building board against a stud of a support structure.

17. The method according to claim 16, wherein said groove extends laterally, inward from the edge side of said framing element in a direction substantially parallel to at least one of the two opposite main sides of said framing element and is configured to receive at least one clamping element inserted in the groove for fixing and holding the building board against a stud of a support structure.

* * * * *